US012195831B2

(12) United States Patent
Murakawa et al.

(10) Patent No.: US 12,195,831 B2
(45) Date of Patent: Jan. 14, 2025

(54) NON-ORIENTED ELECTRICAL STEEL SHEET

(71) Applicant: NIPPON STEEL CORPORATION, Tokyo (JP)

(72) Inventors: Tesshu Murakawa, Tokyo (JP); Miho Tomita, Tokyo (JP); Hiroshi Fujimura, Tokyo (JP); Satoshi Kano, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 436 days.

(21) Appl. No.: 17/774,370

(22) PCT Filed: Nov. 13, 2020

(86) PCT No.: PCT/JP2020/042458
§ 371 (c)(1),
(2) Date: May 4, 2022

(87) PCT Pub. No.: WO2021/095851
PCT Pub. Date: May 20, 2021

(65) Prior Publication Data

US 2022/0356549 A1 Nov. 10, 2022

(30) Foreign Application Priority Data

Nov. 15, 2019 (JP) ..... 2019-206711
Nov. 15, 2019 (JP) ..... 2019-206813

(51) Int. Cl.

| | |
|---|---|
| ***C22C 38/16*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/10*** | (2006.01) |

(52) U.S. Cl.
CPC ..... *C22C 38/16* (2013.01); *C21D 8/0205* (2013.01); *C21D 8/0226* (2013.01); *C21D 8/0236* (2013.01); *C21D 9/46* (2013.01); *C22C 38/002* (2013.01); *C22C 38/008* (2013.01); *C22C 38/02* (2013.01); *C22C 38/04* (2013.01); *C22C 38/06* (2013.01); *C22C 38/08* (2013.01); *C22C 38/105* (2013.01); *C21D 2211/001* (2013.01)

(58) Field of Classification Search
CPC ..... C22C 38/16; C22C 38/002; C22C 38/008; C22C 38/02; C22C 38/04; C22C 38/06; C22C 38/08; C22C 38/105; C22C 38/10; C22C 38/004; C22C 38/60; C21D 8/0205; C21D 8/0226; C21D 8/0236; C21D 9/46; C21D 2211/001; C21D 1/30; C21D 1/76; C21D 6/005; C21D 8/1222; C21D 8/1238; C21D 8/1266; H01F 1/14775; H01F 1/16; H01F 1/147
See application file for complete search history.

(56) References Cited

U.S. PATENT DOCUMENTS

| | | | |
|---|---|---|---|
| 2013/0263981 | A1 | 10/2013 | Zaizen et al. |
| 2018/0030558 | A1 | 2/2018 | Okubo et al. |
| 2018/0202021 | A1 | 7/2018 | Oda et al. |

FOREIGN PATENT DOCUMENTS

| | | | |
|---|---|---|---|
| EP | 3 214 195 | A1 | 9/2017 |
| JP | 2001-303213 | A | 10/2001 |
| JP | 2008-199999 | A | 8/2006 |
| JP | 4029430 | B2 | 1/2008 |
| JP | 4790537 | B2 | 10/2011 |
| JP | 2017-137537 | A | 8/2017 |
| JP | 2017-193731 | A | 10/2017 |
| JP | 6319465 | B2 | 5/2018 |
| JP | 2019-178380 | A | 10/2019 |
| WO | WO 2012/086534 | A1 | 6/2012 |
| WO | WO 2015/170271 | A1 | 11/2015 |

*Primary Examiner* — Adil A. Siddiqui
(74) *Attorney, Agent, or Firm* — Birch, Stewart, Kolasch & Birch, LLP

(57) ABSTRACT

What is provided is a non-oriented electrical steel sheet having a chemical composition in which, by mass %, C: 0.010% or less, Si: 1.50% to 4.00%, sol. Al: 0.0001% to 1.0%, S: 0.010% or less, N: 0.010% or less, one or a plurality of elements selected from the group consisting of Mn, Ni, Co, Pt, Pb, Cu and Au: 2.50% to 5.00% in total are contained and a remainder includes Fe and impurities, in which a sheet thickness is 0.50 mm or less, and, in an arbitrary cross section, when an area ratio of {100} crystal grains is indicated by Sac, an area ratio of {110} crystal grains is indicated by Sag, and an area ratio of the {100} crystal grains in a region of up to 20% from a side where a KAM value is high is indicated by Sbc, Sac>Sbc>Sag and 0.05>Sag are satisfied.

12 Claims, No Drawings

NON-ORIENTED ELECTRICAL STEEL SHEET

TECHNICAL FIELD

The present invention relates to a non-oriented electrical steel sheet.

Priority is claimed on Japanese Patent Application No. 2019-206711, filed Nov. 15, 2019, and Japanese Patent Application No. 2019-206813, filed Nov. 15, 2019, the contents of which are incorporated herein by reference.

BACKGROUND ART

Non-oriented electrical steel sheets are used for, for example, cores of motors, and non-oriented electrical steel sheets are required to be excellent in terms of magnetic characteristics, for example, a low iron loss and a high magnetic flux density, on an average in all directions parallel to a sheet surface thereof (hereinafter, referred to as "the whole circumference average (all-direction average) in the sheet surface" in some cases). A variety of techniques have been thus far proposed, but it is difficult to obtain sufficient magnetic characteristics in all directions in the sheet surface. For example, there are cases where, even when sufficient magnetic characteristics can be obtained in a specific direction in the sheet surface, sufficient magnetic characteristics cannot be obtained in other directions.

CITATION LIST

Patent Document

[Patent Document 1] Japanese Patent No. 4029430
[Patent Document 2] Japanese Patent No. 6319465
[Patent Document 3] Japanese Patent No. 4790537

SUMMARY OF INVENTION

Problems to be Solved by the Invention

The present invention has been made in consideration of the above-described problem, and an objective of the present invention is to provide a non-oriented electrical steel sheet in which excellent magnetic characteristics can be obtained on a whole circumference average (all-direction average).

Means for Solving the Problem (1) A non-oriented electrical steel sheet according to an aspect of the present invention has a chemical composition in which, by mass %,
C: 0.010% or less,
Si: 1.50% to 4.00%,
sol. Al: 0.0001% to 1.0%,
S: 0.010% or less,
N: 0.010% or less,
one or a plurality of elements selected from the group consisting of Mn, Ni, Co, Pt, Pb, Cu and Au: 2.50% to 5.00% in total,
Sn: 0.000% to 0.400%,
Sb: 0.000% to 0.400%,
P: 0.000% to 0.400%, and
one or a plurality of elements selected from the group consisting of Mg, Ca, Sr, Ba, Ce, La, Nd, Pr, Zn and Cd: 0.0000% to 0.0100% in total are contained, when the Mn content (mass %) is indicated by [Mn], the Ni content (mass %) is indicated by [Ni], the Co content (mass %) is indicated by [Co], the Pt content (mass %) is indicated by [Pt], the Pb content (mass %) is indicated by [Pb], the Cu content (mass %) is indicated by [Cu], the Au content (mass %) is indicated by [Au], the Si content (mass %) is indicated by [Si], and the sol. Al content (mass %) is indicated by [sol. Al], Formula (1) below is satisfied, and a remainder includes Fe and impurities, in which a sheet thickness is 0.50 mm or less, and, in an arbitrary cross section, when an area ratio of {100} crystal grains is indicated by Sac, an area ratio of {110} crystal grains is indicated by Sag, and an area ratio of the {100} crystal grains in a region of up to 20% from a side where a kernel average misorientation (KAM) value is high is indicated by Sbc, Sac>Sbc>Sag and 0.05>Sag is satisfied.

$$([Mn]+[Ni]+[Co]+[Pt]+[Pb]+[Cu]+[Au])-([Si]+[sol.Al])>0\% \quad (1).$$

(2) In the non-oriented electrical steel sheet according to (1), when a value of a magnetic flux density B50 in a rolling direction is indicated by B50L, a value of a magnetic flux density B50 in a direction at an angle of 45° from the rolling direction is indicated by B50D1, a value of a magnetic flux density B50 in a direction at an angle of 90° from the rolling direction is indicated by B50C, and a value of a magnetic flux density B50 in a direction at an angle of 135° from the rolling direction is indicated by B50D2, after the non-oriented electrical steel sheet is annealed at 800° C. for two hours, Formula (2) below may be satisfied.

$$(B50D1+B50D2)/2>(B50L+B50C)/2 \quad (2)$$

(3) In the non-oriented electrical steel sheet according to (2), Formula (3) below may be satisfied.

$$(B50D1+B50D2)/2>1.1\times(B50L+B50C)/2 \quad (3)$$

(4) The non-oriented electrical steel sheet according to any one of (1) to (3) may further contain, by mass %, one or a plurality of elements selected from the group consisting of
Sn: 0.020% to 0.400%,
Sb: 0.020% to 0.400%, and
P: 0.020% to 0.400%.

(5) The non-oriented electrical steel sheet according to any one of (1) to (4) may further contain, by mass %, one or a plurality of elements selected from the group consisting of Mg, Ca, Sr, Ba, Ce, La, Nd, Pr, Zn and Cd: 0.0005% to 0.0100% in total.

Effects of the Invention

According to the present invention, it is possible to provide a non-oriented electrical steel sheet in which excellent magnetic characteristics can be obtained on a whole circumference average (all-direction average).

Embodiment(s) for Implementing the Invention

The present inventors carried out intensive studies to solve the above-described problem. As a result, it has been clarified that it is important to make the chemical composition and the distribution of distortions appropriate. Specifically, it has been clarified that it is important to decrease the distortions of {100} crystal grains and to increase the distortions of {111} crystal grains. It has been also clarified that, in the manufacturing of such a non-oriented electrical steel sheet, it is important that a chemical composition of an α-γ transformation system is presupposed, the crystal structure is refined by transformation from austenite to ferrite during hot rolling, furthermore, cold rolling is carried out in a predetermined rolling reduction, the temperature of intermediate annealing is controlled to be within a predetermined range to cause overhanging recrystallization (hereinafter, bulging), and furthermore, skin pass rolling is carried out in a predetermined rolling reduction, thereby facilitating the development of {100} crystal grains, which are, normally, difficult to develop.

A technique for improving magnetic characteristics by imparting pre-distortions is described in Patent Document 3. However, in the method described in Patent Document 3, the magnetic characteristics become favorable in a rolling direction, but the magnetic characteristics become favorable in a width direction or a 45° direction. It is a characteristic of {110} crystal grains that the magnetic characteristics do not become favorable only in one direction. That is, when skin pass rolling is carried out on normal non-oriented electrical steel sheets, the number of {110} crystal grains is likely to increase. This is because, similar to {100} crystal grains, the {110} crystal grains are also not easily distorted and are likely to grow after skin pass rolling. However, the {110} crystal grain has favorable magnetic characteristics in a certain direction, but the magnetic characteristics are almost similar to those of ordinary non-oriented electrical steel sheets on a whole circumference average. On the other hand, the {100} crystal grain has excellent magnetic characteristics even on a whole circumference average. Therefore, it was found that a technique for selectively growing the {100} crystal grains, not the {110} crystal grains, is required.

As a result of repeating additional intensive studies based on such a finding, the present inventors obtained an idea of the present invention.

Hereinafter, an embodiment of the present invention will be described in detail. In the present specification, numerical ranges expressed using "to" include numerical values before and after "to" as the lower limit value and the upper limit value. In addition, it is evident that individual elements of the following embodiment can be combined together.

First, the chemical composition of a steel material that is used in a non-oriented electrical steel sheet according to the embodiment of the present invention and a manufacturing method therefor will be described. In the following description, "%" that is the unit of the amount of each element that is contained in the non-oriented electrical steel sheet or the steel material means "mass %" unless particularly otherwise described. In addition, the chemical composition of the non-oriented electrical steel sheet is indicated by amounts in a case where the amount of the base material excluding a coating or the like is set to 100%.

The non-oriented electrical steel sheet and the steel material according to the present embodiment have a chemical composition in which ferrite-austenite transformation (hereinafter, α-γ transformation) can occur, C: 0.010% or less, Si: 1.50% to 4.00%, sol. Al: 0.0001% to 1.0%, S: 0.010% or less, N: 0.010% or less, one or a plurality of elements selected from the group consisting of Mn, Ni, Co, Pt, Pb, Cu and Au: 2.50% to 5.00% in total, Sn: 0.000% to 0.400%, Sb: 0.000% to 0.400%, P: 0.000% to 0.400% and one or a plurality of elements selected from the group consisting of Mg, Ca, Sr, Ba, Ce, La, Nd, Pr, Zn and Cd: 0.0000% to 0.0100% in total are contained, and the remainder includes Fe and impurities.

In the non-oriented electrical steel sheet and the steel material according to the present embodiment, furthermore, the amounts of Mn, Ni, Co, Pt, Pb, Cu, Au, Si and sol. Al satisfy predetermined conditions to be described below. Examples of the impurities include impurities that are contained in a raw material such as ore or a scrap or impurities that are contained during manufacturing steps.

(C: 0.010% or Less)

C increases the iron loss or causes magnetic aging. Therefore, the C content is preferably as small as possible. Such a phenomenon becomes significant when the C content exceeds 0.010%. Therefore, the C content is set to 0.010% or less. A reduction in the C content also contributes to uniform improvement in the magnetic characteristics in all directions in the sheet surface. The lower limit of the C content is not particularly limited, but is preferably set to 0.0005% or more based on the cost of a decarburization treatment at the time of refining.

(Si: 1.50% to 4.00%)

Si increases the electric resistance to decrease the eddy-current loss to reduce the iron loss or increases the yield ratio to improve punching workability into cores. When the Si content is less than 1.50%, these actions and effects cannot be sufficiently obtained. Therefore, the Si content is set to 1.50% or more. On the other hand, when the Si content is more than 4.00%, the magnetic flux density decreases, the punching workability deteriorates due to an excessive increase in hardness, or cold rolling becomes difficult. Therefore, the Si content is set to 4.00% or less.

(Sol. Al: 0.0001% to 1.0%)

sol. Al increases the electric resistance to decrease the eddy-current loss to reduce the iron loss. sol. Al also contributes to improvement in the relative magnitude of a magnetic flux density B50 with respect to the saturated magnetic flux density. When the sol. Al content is less than 0.0001%, these actions and effects cannot be sufficiently obtained. In addition, Al also has a desulfurization-accelerating effect in steelmaking. Therefore, the sol. Al content is set to 0.0001% or more. On the other hand, when the sol. Al content is more than 1.0%, the magnetic flux density decreases or the yield ratio is decreased to degrade the punching workability. Therefore, the sol. Al content is set to 1.0% or less.

Here, the magnetic flux density B50 refers to a magnetic flux density in a magnetic field of 5000 A/m.

(S: 0.010% or Less)

S is not an essential element and is contained in steel, for example, as an impurity. S causes the precipitation of fine MnS and thereby impairs recrystallization and the growth of crystal grains in annealing. Therefore, the S content is preferably as small as possible. An increase in the iron loss and a decrease in the magnetic flux density resulting from such impairing of recrystallization and crystal grain growth become significant when the S content is more than 0.010%. Therefore, the S content is set to 0.010% or less. The lower limit of the S content is not particularly limited, but is preferably set to 0.0003% or more based on the cost of a desulfurization treatment at the time of refining.

(N: 0.010% or Less)

Similar to C, N degrades the magnetic characteristics, and thus the N content is preferably as small as possible. Therefore, the N content is set to 0.010% or less. The lower limit of the N content is not particularly limited, but is preferably set to 0.0010% or more based on the cost of a denitrification treatment at the time of refining.

(One or a plurality of elements selected from the group consisting of Mn, Ni, Co, Pt, Pb, Cu and Au: 2.50% to 5.00% in total)

Since Mn, Ni, Co, Pt, Pb, Cu or Au is a necessary element to cause α-γ transformation, at least one of these elements needs to be contained in total of 2.50% or more. In addition, regarding the amount of these elements, from the viewpoint of increasing the electric resistance to decrease the iron loss, the total of at least one or a plurality of these elements is more preferably set to more than 2.50%. On the other hand, when the amount of these elements exceeds 5.00% in total, there is a case where the cost increases and the magnetic flux density decreases. Therefore, the total of at least one of these elements is set to 5.00% or less.

In addition, the non-oriented electrical steel sheet and the steel material according to the present embodiment are made to further satisfy the following conditions as conditions for enabling the occurrence of α-γ transformation. That is, when the Mn content (mass %) is indicated by [Mn], the Ni content (mass %) is indicated by [Ni], the Co content (mass %) is indicated by [Co], the Pt content (mass %) is indicated by [Pt], the Pb content (mass %) is indicated by [Pb], the Cu content (mass %) is indicated by [Cu], the Au content (mass %) is indicated by [Au], the Si content (mass %) is indicated by [Si], and the sol. Al content (mass %) is indicated by [sol. Al], the contents are made to satisfy Formula (1) below, by mass %.

$$([Mn]+[Ni]+[Co]+[Pt]+[Pb]+[Cu]+[Au])-([Si]+[sol.Al])>0\% \quad (1).$$

In a case where Formula (1) is not satisfied, since α-γ transformation does not occur, the magnetic flux density decreases.

(Sn: 0.000% to 0.400%, Sb: 0.000% to 0.400% and P: 0.000% to 0.400%)

Sn or Sb improves the texture after cold rolling or recrystallization to improve the magnetic flux density. Therefore, these elements may be contained as necessary; however, when excessively contained, steel becomes brittle. Therefore, the Sn content and the Sb content are both set to 0.400% or less. In addition, P may be contained to ensure the hardness of the steel sheet after recrystallization; however, when excessively contained, the embrittlement of steel is caused. Therefore, the P content is set to 0.400% or less. In the case of imparting an additional effect on the magnetic characteristics or the like, one or a plurality of elements selected from the group consisting of 0.020% to 0.400% of Sn, 0.020% to 0.400% of Sb and 0.020% to 0.400% of P are preferably contained.

(One or a plurality of elements selected from the group consisting of Mg, Ca, Sr, Ba, Ce, La, Nd, Pr, Zn and Cd: 0.0000% to 0.0100% in total)

Mg, Ca, Sr, Ba, Ce, La, Nd, Pr, Zn and Cd react with S in molten steel during the casting of the molten steel to generate the precipitate of a sulfide, an oxysulfide or both. Hereinafter, Mg, Ca, Sr, Ba, Ce, La, Nd, Pr, Zn and Cd will be collectively referred to as "coarse precipitate forming element" in some cases. The grain diameters in the precipitate of the coarse precipitate forming element are approximately 1 μm to 2 μm, which is significantly larger than the grain diameters (approximately 100 nm) of the fine precipitates of MnS, TiN, AlN or the like. Therefore, these fine precipitates adhere to the precipitate of the coarse precipitate forming element and are less likely to impair recrystallization and the growth of crystal grains in annealing such as intermediate annealing. In order to sufficiently obtain this actions and effect, the total of the coarse precipitate forming element is preferably 0.0005% or more. However, when the total of these elements exceeds 0.0100%, the total amount of the sulfide, the oxysulfide or both becomes excessive, and recrystallization and the growth of crystal grains in annealing such as intermediate annealing are impaired. Therefore, the amount of the coarse precipitate forming element is set to 0.0100% or less in total.

Next, the thickness of the non-oriented electrical steel sheet according to the present embodiment will be described. The thickness of the non-oriented electrical steel sheet according to the present embodiment is 0.50 mm or less. When the thickness exceeds 0.50 mm, it is not possible to obtain an excellent high-frequency iron loss. Therefore, the thickness is set to 0.50 mm or less. In addition, from the viewpoint of facilitating the manufacturing, the thickness of the non-oriented electrical steel sheet according to the present embodiment is more preferably 0.10 mm or more.

Next, the distribution of distortions in the non-oriented electrical steel sheet according to the present embodiment will be described. The non-oriented electrical steel sheet according to the present embodiment has a distribution of distortions which makes it possible to obtain a high magnetic flux density in all directions more wholly. Specifically, the non-oriented electrical steel sheet according to the present embodiment satisfies Sac>Sbc>Sag and 0.05>Sag.

Next, Sac, Sag and Sbc will be described. Sac is the area ratio of the {100} crystal grains in an arbitrary cross section, and Sag is the area ratio of the {110} crystal grains in an arbitrary cross section. In the case of observing an arbitrary cross section (a cross section of a central layer in the sheet thickness direction of the non-oriented electrical steel sheet), when the total area of the cross section is indicated by Sall, the area of the {100} crystal grains in the cross section is indicated by Sallc, and the area of the {110} crystal grains in the cross section is indicated by Sallg, Sac is indicated by Sac=Sallc/Sall. In addition, Sag is indicated by Sag=Sallg/Sall. The {100} crystal grain (or {110} crystal grain) refers to a crystal grain that is defined within a tolerance of 10° or less from a target crystal orientation.

Sbc is the area ratio of the {100} crystal grains in a region exhibiting a predetermined KAM value. Sbc is defined as described below. When the total area of a region in a range of up to 20% from the side where the kernel average misorientation (KAM) value is high in the same cross section as described above is indicated by Ssab, and the area of the {100} crystal grains in the region in the range of up to 20% from the side where the KAM value is high is indicated by Ssabc, Sbc is indicated by Sbc=Ssabc/Ssab.

The KAM value indicates an orientation difference in a certain measurement point from a measurement point adjacent thereto in the same grain (however, in a case where the adjacent measurement point is in a different crystal grain, the adjacent measurement point is excluded in the calculation of the KAM). In a place where there are a large number of distortions, the KAM value increases. Only a highly distorted region can be extracted by taking out a region of up to 20% from the side where such a KAM value is high. The measurement point is a region composed of an arbitrary pixel. The size of the pixel that configures the measurement point is preferably 0.01 to 0.10 μm from the viewpoint of accurately obtaining the KAM value.

The region of up to 20% from the side where the KAM value is high is obtained as described below. First, a histogram showing the frequency distribution of the KAM values in the above-described cross section, which is an object, is created. This histogram shows the frequency distribution of the KAM values in the above-described cross section. Next, this histogram is converted into a cumulative histogram. In addition, in the cumulative histogram, a range that occupies up to 20% (0% to 20%) of cumulative relative frequencies from the side where the KAM value is high is determined. Furthermore, a region (a) including the KAM values in this range is shaped (mapped) on the cross section as the "region of up to 20% from the side where the KAM value is high". That is, the area of the region (a) shaped as described above is Ssab. Next, in the above-described cross section, a region (b) of the {100} crystal grains is shaped, and a region (c) where the region (a) and the region (b) overlap is obtained. The area of the region (c) shaped as described above is Ssabc.

Sallc, Sallg, Ssabc and the like do not strictly indicate the areas of crystal grains in the corresponding orientations and also include the areas of crystal grains in orientations allowing up to 10° of deviation (tolerance) from the corresponding orientations, for example.

The KAM values can be calculated by analyzing an image of a cross section of a sample with software such as OIM Analysis. The highest value of the KAM values is automatically imparted with the same software. In the above description, the side where the KAM value is high means the side of the highest value of the KAM values in the frequency distribution of the KAM values. For example, in the case of a cumulative histogram having an origin at a KAM value of zero, the range that occupies up to 20% of cumulative relative frequencies from the side where the KAM value is high becomes a range of cumulative relative frequencies of 1 to 0.8.

Here, in order to obtain the above-described relationships, the area ratio of a polished surface of a material obtained by polishing ½ of a steel sheet that is a sample collected from the non-oriented electrical steel sheet can be obtained by, for example, the electron backscattering diffraction (EBSD) method. The KAM values can be obtained by calculating an inverse pole figure (IPF) from the observed visual fields of EBSD. The sample is preferably collected from the central layer in a base steel sheet of the non-oriented electrical steel sheet. The observed visual field is preferably 2400 $\mu m^2$ or more, and the average value of individual numerical values calculated regarding a plurality of visual fields is preferably adopted.

The relationship Sac>Sag in the above-described inequality indicates that the proportion of the {100} crystal grains in the entirety is larger than the proportion of the {110} crystal grains. In annealing after a skin pass, both the {100} crystal grains and the {110} crystal grains are likely to grow. Here, since the magnetic characteristics on a whole circumference average are superior in the {100} crystal grains to the {110} crystal grains, it is more preferable to increase the number of the {100} crystal grains.

Next, the relationship Sac>Sbc means that, in the {100} crystal grains, regions where there are a large number of distortions are relatively small. It is known that, in annealing after skin pass rolling, grains where there are a small number of distortions invade grains where there are a large number of distortions. Therefore, this inequality means that the {100} crystal grains are likely to grow.

In the non-oriented electrical steel sheet according to the present embodiment, since the {100} crystal grains grow, and furthermore, the {100} crystal grains are likely to grow in the structure, the area ratio Sag of the {110} crystal grains becomes less than 0.05. When the area ratio Sag of the {110} crystal grains is 0.05 or more, excellent magnetic characteristics cannot be obtained. In addition, the reason for Sbc>Sag is that the magnetic characteristics improve in the whole circumference when the proportion of the {100} crystal grains is larger than the proportion of the {110} crystal grains in a highly distorted region.

Next, the magnetic characteristics of the non-oriented electrical steel sheet according to the present embodiment will be described. At the time of investigating the magnetic characteristics, the magnetic flux density is measured after the non-oriented electrical steel sheet according to the present embodiment is further annealed under conditions of 800° C. and two hours. In the non-oriented electrical steel sheet according to the present embodiment, the magnetic characteristics are most favorable in two directions where, between angles formed by the rolling direction and each of the two directions, the small angle becomes 45°. On the other hand, in two directions where the angle formed by the rolling direction and each of the two directions is 0° or 90°, the magnetic characteristics are poorest. Here, the "45°" is a theoretical value, and, at the time of actual manufacturing, there is a case where it is not easy to match the angle to 45°. Therefore, as long as the directions where the magnetic characteristics are most favorable are theoretically two directions where, between the angles formed by the rolling direction and each of the two directions, the small angle becomes 45°, in actual non-oriented electrical steel sheets, a direction where the 45° is not (strictly) matched to 45° is also regarded as the above-described direction. What has been described above also applies to the "0°" and "90°".

In addition, theoretically, the magnetic characteristics in the two directions where the magnetic characteristics are most favorable become the same as each other, but there is a case where it is not easy to make the magnetic characteristics in the two directions the same as each other at the time of actual manufacturing. Therefore, as long as the magnetic characteristics in the two directions where the magnetic characteristics are most favorable are theoretically the same as each other, the magnetic characteristics being not (strictly) the same as each other are also regarded as the above-described magnetic characteristics that are the same as each other. What has been described above also applies to the two directions where the magnetic characteristics are poorest. Regarding the above-described angles, both clockwise angles and counter-clockwise angles are expressed as positive values. In a case where the clockwise direction is expressed as a negative direction and the counter-clockwise direction is expressed as a positive direction, the two directions where, between the above-described angles formed by the rolling direction and each of the two directions, the small angle becomes 45° become two directions where, between the above-described angles formed by the rolling direction and each of the two directions, the angle with a small absolute value becomes 45° or −45°. In addition, the two directions where, between the above-described angles formed by the rolling direction and each of the two directions, the small angle becomes 45° can also be expressed as two directions where the angles formed by the rolling direction and each of the two directions become 45° and 135°.

When the magnetic flux density of the non-oriented electrical steel sheet according to the present embodiment is measured, the magnetic flux density B50 (corresponding to B50D1 and B50D2) in a 45° direction with respect to the rolling direction becomes 1.75 T or more. In the non-oriented electrical steel sheet according to the present embodiment, while the magnetic flux density in the 45° direction with respect to the rolling direction is high, high magnetic flux densities can also be obtained on a whole circumference average (all-direction average).

In the non-oriented electrical steel sheet according to the present embodiment, when the value of the magnetic flux density B50 in the rolling direction is indicated by B50L, the value of the magnetic flux density B50 in a direction at an angle of 45° from the rolling direction is indicated by B50D1, the value of the magnetic flux density B50 in a direction at an angle of 90° from the rolling direction is indicated by B50C, and the value of the magnetic flux density B50 in a direction at an angle of 135° from the rolling direction is indicated by B50D2, after the non-oriented electrical steel sheet is annealed at 800° C. for two hours, an anisotropy of the magnetic flux density where B50D1 and B50D2 are highest and B50L and B50C are lowest is shown.

Here, for example, in the case of considering an all-direction (0° to) 360° distribution of the magnetic flux densities for which the clockwise (which may be counter-clockwise) direction is regarded as a positive direction, when the rolling direction is set to 0° (one direction) and 180° (the other direction), B50D1 becomes the values of the magnetic flux density B50 at 45° and 225°, and B50D2 becomes the values of the magnetic flux density B50 at 135° and 315°. Similarly, B50L becomes the values of the magnetic flux density B50 at 0° and 180°, and B50C becomes the values of the magnetic flux density B50 at 90° and 270°. The value of the magnetic flux density B50 at 45° and the value of the magnetic flux density B50 at 225° strictly coincide with each other, and the value of the magnetic flux density B50 at 135° and the value of the magnetic flux density B50 at 315° strictly coincide with each other. However, since there is a case where it is not easy to make the magnetic characteristics the same as each other at the time of actual manufacturing, there is a case where B50D1's and B50D2's do not strictly coincide. Similarly, the value of the magnetic flux density B50 at 0° and the value of the magnetic flux density B50 at 180° strictly coincide with each other, and the value of the magnetic flux density B50 at 90° and the value of the magnetic flux density B50 at 270° strictly coincide with each other, but there is a case where B50L's and B50C's do not strictly coincide. In manufactured non-oriented electrical steel sheets, one rolling direction and the other rolling direction (the direction opposite to the above-described rolling direction) cannot be distinguished. Therefore, in the present embodiment, the rolling direction refers to both the one rolling direction and the other rolling direction.

In the non-oriented electrical steel sheet according to the present embodiment, Formula (2) below is more preferably satisfied using the average value of B50D1 and B50D2 and the average value of B50L and B50C.

$$(B50D1+B50D2)/2>(B50L+B50C)/2 \quad (2)$$

By having such a high anisotropy of the magnetic flux density, the non-oriented electrical steel sheet has an advantage of being suitable for split core-type motor materials.

In addition, by satisfying Formula (3) below, the non-oriented electrical steel sheet according to the present embodiment can be more preferably used as split core-type motor materials.

$$(B50D1+B50D2)/2>1.1\times(B50L+B50C)/2 \quad (3)$$

The magnetic flux density can be measured from 55 mm×55 mm samples cut out in directions at angles of 45°, 0° and the like with respect to the rolling direction using a single-sheet magnetic measuring instrument.

Next, a method for manufacturing the non-oriented electrical steel sheet according to the present embodiment will be described. In the present embodiment, hot rolling, cold rolling, intermediate annealing, skin pass rolling and the like are carried out.

First, the above-described steel material is heated and hot-rolled. The steel material is, for example, a slab that is manufactured by normal continuous casting. Rough rolling and finish rolling of the hot rolling are carried out at temperatures in the γ range (Ar1 temperature or higher). That is, the hot rolling is preferably carried out such that the temperature (finishing temperature) reaches the Ar1 temperature or higher when the steel material passes through the final pass of the finish rolling. In such a case, the steel material transforms from austenite to ferrite by subsequent cooling, whereby the crystal structure is refined. When subsequent cold rolling is carried out in a state where the crystal structure has been refined, bulging is likely to occur, and it is possible to facilitate growth of the {100} crystal grains, which are, normally, difficult to grow. The Ar1 temperature in the present embodiment is obtained from a thermal expansion change of the steel material (steel sheet) under cooling at an average cooling rate of 1° C./second. In addition, the Ac1 temperature in the present embodiment is obtained from a thermal expansion change of the steel material (steel sheet) under heating at an average heating rate of 1° C./second.

After that, the hot-rolled steel sheet is wound without being annealed. The temperature at the time of the winding is set to higher than 250° C. and 600° C. or lower, whereby it is possible to refine the crystal structure before cold rolling and to enrich the {100} orientation in which the magnetic characteristics are excellent during bulging. The temperature at the time of the winding is more preferably 400° C. to 500° C. and still more preferably 400° C. to 480° C.

After that, the hot-rolled steel sheet is pickled and cold-rolled. In the cold rolling, the rolling reduction is preferably set to 80% to 92%, but the rolling reduction of the cold rolling is adjusted in the relationship with skin pass rolling in order to obtain the above-described distribution of distortions. That is, the rolling reduction of the cold rolling is determined by being calculated backward from the rolling reduction in the skin pass rolling so as to obtain a product sheet thickness.

When the cold rolling ends, subsequently, intermediate annealing is carried out. In the present embodiment, the intermediate annealing is carried out at a temperature at which the steel material does not transform into austenite. That is, the temperature in the intermediate annealing is preferably set to lower than the Ac1 temperature. When the intermediate annealing is carried out as described above, bulging occurs, and it becomes easy for the {100} crystal grains to grow. In addition, the time of the intermediate annealing is preferably set to 5 to 60 seconds.

When the intermediate annealing ends, next, skin pass rolling is carried out. When the rolling is carried out in a state where bulging has occurred as described above, and then annealing is carried out, strain-induced grain boundary migration (hereinafter, SIBM) in which the {100} crystal grains further grow from a portion where the bulging has occurred as a starting point occurs. The rolling reduction of the skin pass rolling is set to 5% to 25%. When the rolling reduction of the skin pass rolling is smaller than 5%, since the amount of distortions that are accumulated in the steel sheet is small, SIBM does not occur. On the other hand, when the rolling reduction of the skin pass rolling is larger than 20%, the number of distortions is too large, and nucleation rather than SIBM occurs. Since the number of the {100} crystal grains increases during SIBM, and the number of the {111} crystal grains increases during nucleation, it is necessary to cause SIBM in order to improve the magnetic characteristics. The rolling reduction of the skin pass rolling is more preferably set to 5% to 15% from the viewpoint of obtaining a high anisotropy of the magnetic flux density.

In manufacturing steps of a product such as an actual motor core, forming or the like is carried out on the non-oriented electrical steel sheet to produce a desired steel member. In addition, in order to remove distortions or the like generated by forming or the like (for example, punching) carried out on the steel member made of the non-oriented electrical steel sheet, there is a case where stress relief annealing is carried out on the steel member. In a case where stress relief annealing is carried out on the non-oriented electrical steel sheet according to the present embodiment, it is preferable to set the temperature in the stress relief annealing to, for example, approximately 800° C. and to set the time of the stress relief annealing to approximately two hours.

The non-oriented electrical steel sheet according to the present embodiment can be manufactured as described above.

Steel members made of the non-oriented electrical steel sheet according to the present embodiment are applied to, for example, cores (motor cores) of rotary electric machines. In this case, individual flat sheet-like thin sheets are cut out from the non-oriented electrical steel sheet according to the present embodiment, and these flat sheet-like thin sheets are appropriately laminated, thereby producing an iron core that is used in a rotary electric machine. Since the non-oriented electrical steel sheet having excellent magnetic characteristics is applied to this core and the iron loss is suppressed at a low level, a rotary electric machine in which the torque is excellent is realized. Steel members made of the non-oriented electrical steel sheet according to the present embodiment can also be applied to products other than the cores of rotary electric machines, for example, cores for linear motors, static devices (reactors or transformers) or the like.

EXAMPLES

Next, a method for manufacturing a non-oriented electrical steel sheet according to an embodiment of the present invention will be specifically described while describing examples. The examples to be described below are simply examples of the method for manufacturing the non-oriented electrical steel sheet according to the embodiment of the present invention, and the method for manufacturing the non-oriented electrical steel sheet according to the present invention is not limited to the examples to be described below.

First Example

Molten steel was cast, thereby producing ingots having compositions shown in Table 1 below. After that, the produced ingots were hot-rolled by being heated up to 1150° C. and rolled such that the sheet thicknesses reached 2.5 mm. However, in No. 110, the ingot was hot-rolled such that the sheet thickness reached 1.6 mm. In addition, after the end of finish rolling, the hot-rolled steel sheets were cooled with water and wound. The temperature (finishing temperature) in a stage of the final pass of the finish rolling at this time was 830° C. and was higher than the Ar1 temperature except for No. 108 and No. 110. In No. 108 where γ-α transformation did not occur, the finishing temperature was set to 850° C., and, in No. 110, the finishing temperature was set to 750° C., which is lower than the Ar1 temperature, for the purpose of controlling Sag. In addition, the winding temperatures at the time of the winding were set to 500° C. Here, "left side of formula" in the table indicates the value of the left side of Formula (1) described above.

Next, the hot-rolled steel sheets were pickled to remove scales. Cold rolling was carried out such that the rolling reductions changed as shown in Table 1 depending on samples. In addition, intermediate annealing was carried out for 30 seconds by heating the cold-rolled steel sheets up to 700° C., which is lower than the Ar1 temperature, in a non-oxidizing atmosphere. However, in No. 111, the intermediate annealing was carried out at 900° C., which is the Ar1 temperature or higher, for the purpose of changing the values of Sac and Sbc. Next, a second round of cold rolling (skin pass rolling) was carried out such that the rolling reductions changed as shown in Table 1 depending on the samples. In No. 112, the skin pass rolling was not carried out. Here, for No. 116, the hot-rolled steel sheet was cold-rolled to a thickness of 0.360 mm, and, after the intermediate annealing, the second round of the cold rolling was carried out until the sheet thickness reached 0.35 mm.

Next, stress relief annealing was carried out at 800° C. for two hours after the second round of the cold rolling (skin pass rolling) in order to investigate the magnetic characteristics, and the magnetic flux densities B50 were measured. As measurement samples, 55 mm×55 mm samples were collected in two directions at angles of 0° C. and 45° C. with respect to a rolling direction. In addition, the magnetic flux densities B50 of these two types of samples were measured, the value of the magnetic flux density B50 in a direction at an angle of 45° with respect to the rolling direction was regarded as B50D1, the value of the magnetic flux density B50 in a direction at an angle of 135° with respect to the rolling direction was regarded as B50D2, the value of the magnetic flux density B50 in the rolling direction was regarded as B50L, and the value of the magnetic flux density B50 in a direction at an angle of 90° with respect to the rolling direction was regarded as B50C. In addition, the average value of B50D1, B50D2, B50L and B50C was regarded as the whole circumference average of the magnetic flux density B50. These conditions and measurement results are shown in Table 1 and Table 2.

In addition, ½ layers of the steel sheets after the skin pass rolling were exposed by polishing and measured by SEM-EBSD, and the area ratios of crystal grains in each orientation and the KAM values were calculated using OIM Analysis. In addition, Sac, Sbc and Sag were each calculated from the obtained KAM values. The calculation methods therefor are as described above in the embodiment. The observed visual fields were 2400 μm, and each numerical value is the average value of each sample.

TABLE 1

| No. | Composition (mass %) | | | | | | | | | | | | | Rolling reduction (%) | | Note |
|---|---|---|---|---|---|---|---|---|---|---|---|---|---|---|---|---|
| | C | Si | sol-Al | S | N | Mn | Ni | Co | Pt | Pb | Cu | Au | Left side of formula | Cold rolling | Skin pass rolling | |
| 101 | 0.0009 | 2.50 | 0.0085 | 0.0021 | 0.0022 | 3.11 | — | — | — | — | — | — | 0.60 | 85 | 9 | Invention Example |
| 102 | 0.0009 | 2.51 | 0.0083 | 0.0023 | 0.0019 | — | 3.10 | — | — | — | — | — | 0.58 | 85 | 9 | Invention Example |
| 103 | 0.0013 | 2.49 | 0.0068 | 0.0019 | 0.0022 | — | — | 3.12 | — | — | — | — | 0.62 | 85 | 9 | Invention Example |
| 104 | 0.0007 | 2.50 | 0.0125 | 0.0023 | 0.0023 | — | — | — | 3.11 | — | — | — | 0.59 | 85 | 9 | Invention Example |
| 105 | 0.0008 | 2.51 | 0.0091 | 0.0021 | 0.0019 | — | — | — | — | 3.13 | — | — | 0.61 | 85 | 9 | Invention Example |
| 106 | 0.0011 | 2.52 | 0.0126 | 0.0020 | 0.0022 | — | — | — | — | — | 3.12 | — | 0.58 | 85 | 9 | Invention Example |
| 107 | 0.0007 | 2.52 | 0.0110 | 0.0018 | 0.0018 | — | — | — | — | — | — | 3.13 | 0.60 | 85 | 9 | Invention Example |
| 108 | 0.0008 | 3.17 | 0.0106 | 0.0018 | 0.0022 | 3.07 | — | — | — | — | — | — | −0.11 | 85 | 9 | Comparative Example |
| 109 | 0.0010 | 2.46 | 0.3024 | 0.0016 | 0.0024 | 3.43 | — | — | — | — | — | — | 0.67 | 85 | 9 | Invention Example |
| 110 | 0.0008 | 2.47 | 0.0129 | 0.0016 | 0.0022 | 3.06 | — | — | — | — | — | — | 0.58 | 66 | 9 | Comparative Example |
| 111 | 0.0009 | 2.54 | 0.0083 | 0.0020 | 0.0020 | 3.10 | — | — | — | — | — | — | 0.56 | 85 | 9 | Comparative Example |
| 112 | 0.0010 | 2.47 | 0.0086 | 0.0023 | 0.0017 | 3.10 | — | — | — | — | — | — | 0.62 | 85 | Not performed | Comparative Example |
| 113 | 0.0007 | 2.51 | 0.0117 | 0.0023 | 0.0016 | 3.13 | — | — | — | — | — | — | 0.61 | 78 | 9 | Invention Example |
| 114 | 0.0008 | 2.51 | 0.0122 | 0.0016 | 0.0018 | 3.13 | — | — | — | — | — | — | 0.61 | 89 | 9 | Invention Example |
| 115 | 0.0013 | 2.53 | 0.0106 | 0.0020 | 0.0023 | 3.13 | — | — | — | — | — | — | 0.59 | 96 | 9 | Invention Example |
| 116 | 0.0011 | 2.51 | 0.0107 | 0.0018 | 0.0020 | 3.11 | — | — | — | — | — | — | 0.59 | 85 | 3 | Invention Example |
| 117 | 0.0012 | 2.49 | 0.5987 | 0.0020 | 0.0023 | 3.71 | — | — | — | — | — | — | 0.62 | 85 | 9 | Invention Example |
| 118 | 0.0009 | 2.50 | 0.8991 | 0.0018 | 0.0020 | 3.99 | — | — | — | — | — | — | 0.59 | 85 | 9 | Invention Example |

TABLE 2

| No. | Characteristics of steel sheet | | | | B50 after annealing at 800° C. for two hours (T) | | | | | | | Note |
|---|---|---|---|---|---|---|---|---|---|---|---|---|
| | Sac | Sbc | Sag | Sheet thickness (mm) | Whole circumference average B50 | B50D1 (T) | B50D2 (T) | B50L (T) | B50C (T) | Formula (2) | Formula (3) | |
| 101 | 0.242 | 0.091 | 0.007 | 0.35 | 1.681 | 1.810 | 1.808 | 1.558 | 1.548 | ○ | ○ | Invention Example |
| 102 | 0.244 | 0.091 | 0.006 | 0.35 | 1.677 | 1.813 | 1.812 | 1.556 | 1.527 | ○ | ○ | Invention Example |
| 103 | 0.239 | 0.093 | 0.012 | 0.35 | 1.683 | 1.812 | 1.810 | 1.556 | 1.553 | ○ | ○ | Invention Example |
| 104 | 0.237 | 0.091 | 0.013 | 0.35 | 1.676 | 1.807 | 1.810 | 1.557 | 1.531 | ○ | ○ | Invention Example |
| 105 | 0.241 | 0.089 | 0.009 | 0.35 | 1.677 | 1.813 | 1.812 | 1.556 | 1.528 | ○ | ○ | Invention Example |
| 106 | 0.239 | 0.088 | 0.007 | 0.35 | 1.683 | 1.808 | 1.813 | 1.556 | 1.555 | ○ | ○ | Invention Example |
| 107 | 0.241 | 0.090 | 0.010 | 0.35 | 1.678 | 1.812 | 1.811 | 1.555 | 1.534 | ○ | ○ | Invention Example |
| 108 | 0.106 | 0.084 | 0.037 | 0.35 | 1.609 | 1.546 | 1.558 | 1.686 | 1.646 | X | X | Comparative Example |
| 109 | 0.239 | 0.090 | 0.011 | 0.35 | 1.671 | 1.787 | 1.786 | 1.561 | 1.550 | ○ | ○ | Invention Example |
| 110 | 0.212 | 0.122 | 0.110 | 0.50 | 1.649 | 1.551 | 1.559 | 1.689 | 1.796 | X | X | Comparative Example |
| 111 | 0.057 | 0.081 | 0.042 | 0.35 | 1.632 | 1.518 | 1.561 | 1.689 | 1.760 | X | X | Comparative Example |
| 112 | 0.154 | 0.033 | 0.039 | 0.35 | 1.631 | 1.536 | 1.561 | 1.687 | 1.740 | X | X | Comparative Example |

TABLE 2-continued

| | Characteristics of steel sheet | | | | B50 after annealing at 800° C. for two hours (T) | | | | | | | |
|---|---|---|---|---|---|---|---|---|---|---|---|---|
| No. | Sac | Sbc | Sag | Sheet thickness (mm) | Whole circumference average B50 | B50D1 (T) | B50D2 (T) | B50L (T) | B50C (T) | Formula (2) | Formula (3) | Note |
| 113 | 0.238 | 0.086 | 0.009 | 0.50 | 1.680 | 1.807 | 1.810 | 1.551 | 1.553 | ○ | ○ | Invention Example |
| 114 | 0.243 | 0.093 | 0.010 | 0.25 | 1.681 | 1.814 | 1.809 | 1.552 | 1.548 | ○ | ○ | Invention Example |
| 115 | 0.237 | 0.091 | 0.014 | 0.10 | 1.707 | 1.840 | 1.813 | 1.552 | 1.622 | ○ | ○ | Invention Example |
| 116 | 0.221 | 0.065 | 0.022 | 0.35 | 1.680 | 1.760 | 1.759 | 1.577 | 1.625 | ○ | X | Invention Example |
| 117 | 0.240 | 0.091 | 0.008 | 0.35 | 1.658 | 1.777 | 1.780 | 1.548 | 1.528 | ○ | ○ | Invention Example |
| 118 | 0.244 | 0.091 | 0.009 | 0.35 | 1.649 | 1.769 | 1.768 | 1.540 | 1.520 | ○ | ○ | Invention Example |

Underlined values in Table 1 and Table 2 indicate conditions deviating from the scope of the present invention. In all of No. 101 to No. 107, No. 109 and No. 113 to No. 118, which were invention examples, the magnetic flux densities B50 were favorable values both in the 45° direction and on the whole circumference average. On the other hand, in No. 108, which was a comparative example, since the Si concentration was high, the value of the left side of the formula was 0 or less, and the composition did not undergo α-γ transformation, the magnetic flux densities B50 were all low. In No. 110, which was a comparative example, since Sag exceeded 0.05, the magnetic flux density was low. In No. 111 and No. 112, which were comparative examples, since Sac>Sbc>Sag was not satisfied, the magnetic flux densities B50 were all low. In the case of No. 111, it is considered that, since the temperature in the intermediate annealing was higher than the Ac1 temperature, α-γ transformation occurred, the number of the {100} crystal grains decreased, a number of distortions remained in the {100} crystal grains, and the stress relief annealing after the skin pass rolling did not make the {100} crystal grains sufficiently grow. In No. 116, the magnetic characteristics were favorable, but the rolling reduction in the skin pass rolling was changed, and thus Formula (3) was not satisfied.

Second Example

Molten steel was cast, thereby producing ingots having compositions shown in Table 3 below. After that, the produced ingots were hot-rolled by being heated up to 1150° C. and rolled such that the sheet thicknesses reached 2.5 mm. In addition, after the end of finish rolling, the hot-rolled steel sheets were cooled with water and wound. The finishing temperature in a stage of the final pass of the finish rolling at this time was 830° C. and all temperatures were higher than the Ar1 temperature. In addition, the winding temperatures at the time of the winding were set to 500° C.

Next, the hot-rolled steel sheets were pickled to remove scales. Next, cold rolling was carried out in a rolling reduction of 85% such that the sheet thickness reached 0.385 mm. In addition, intermediate annealing was carried out for 30 seconds by heating the cold-rolled steel sheets up to 700° C., which is lower than the Ar1 temperature, in a non-oxidizing atmosphere. Next, a second round of the cold rolling (skin pass rolling) was carried out in a rolling reduction of 9% until the sheet thicknesses reached 0.35 mm. Here, for No. 215, the hot-rolled steel sheet was cold-rolled to a thickness of 0.360 mm, and, after the intermediate annealing, the second round of the cold rolling was carried out until the sheet thickness reached 0.35 mm.

Next, stress relief annealing was carried out at 800° C. for two hours after the second round of the cold rolling (skin pass rolling) in order to investigate the magnetic characteristics, and the magnetic flux densities B50 and the iron losses W10/400 were measured. The magnetic flux densities B50 were measured in the same order as in the first example. On the other hand, the iron loss W10/400 was measured as an energy loss (W/kg) on a whole circumference average that was caused in a sample when an alternating-current magnetic field of 400 Hz was applied such that the maximum magnetic flux density reached 1.0 T. These conditions and results are shown in Table 3 and Table 4.

In addition, ½ layers of the steel sheets after the skin pass rolling were exposed by polishing and measured by SEM-EBSD, and the area ratios of crystal grains in each orientation and the KAM values were calculated using OIM Analysis. In addition, Sac, Sbc and Sag were each calculated from the obtained KAM values. The calculation methods therefor are as described above in the embodiment. The observed visual fields were 2400 and each numerical value is the average value of each sample.

TABLE 3

| | Composition (mass %) | | | | | | | | | | | |
|---|---|---|---|---|---|---|---|---|---|---|---|---|
| No. | C | Si | sol-Al | S | N | Mn | Sn | Sb | P | Mg | Ca | Sr |
| 201 | 0.0013 | 2.51 | 0.0123 | 0.0016 | 0.0021 | 3.10 | — | — | — | — | — | — |
| 202 | 0.0012 | 2.52 | 0.0125 | 0.0022 | 0.0018 | 3.11 | 0.05 | — | — | — | — | — |
| 203 | 0.0008 | 2.48 | 0.0090 | 0.0017 | 0.0024 | 3.09 | — | 0.05 | — | — | — | — |
| 204 | 0.0009 | 2.53 | 0.0100 | 0.0021 | 0.0021 | 3.09 | — | — | 0.05 | — | — | — |
| 205 | 0.0007 | 2.54 | 0.0104 | 0.0024 | 0.0018 | 3.07 | — | — | — | 0.0049 | — | — |
| 206 | 0.0013 | 2.53 | 0.0118 | 0.0020 | 0.0017 | 3.11 | — | — | — | — | 0.0053 | — |
| 207 | 0.0006 | 2.54 | 0.0113 | 0.0022 | 0.0022 | 3.13 | — | — | — | — | — | 0.0050 |

TABLE 3-continued

| | | | | | | | | | | | | |
|---|---|---|---|---|---|---|---|---|---|---|---|---|
| 208 | 0.0014 | 2.52 | 0.0129 | 0.0024 | 0.0017 | 3.06 | — | — | — | — | — | — |
| 209 | 0.0011 | 2.47 | 0.0140 | 0.0019 | 0.0024 | 3.12 | — | — | — | — | — | — |
| 210 | 0.0011 | 2.53 | 0.0061 | 0.0022 | 0.0022 | 3.08 | — | — | — | — | — | — |
| 211 | 0.0008 | 2.52 | 0.0103 | 0.0020 | 0.0017 | 3.06 | — | — | — | — | — | — |
| 212 | 0.0006 | 2.52 | 0.0123 | 0.0016 | 0.0018 | 3.09 | — | — | — | — | — | — |
| 213 | 0.0010 | 2.47 | 0.0088 | 0.0020 | 0.0018 | 3.07 | — | — | — | — | — | — |
| 214 | 0.0008 | 2.51 | 0.0104 | 0.0024 | 0.0018 | 3.08 | — | — | — | — | — | — |
| 215 | 0.0011 | 2.49 | 0.0096 | 0.0020 | 0.0021 | 3.09 | 0.05 | — | — | — | — | — |
| 216 | 0.0009 | 2.49 | 0.6026 | 0.0020 | 0.0020 | 3.72 | 0.05 | — | — | — | — | — |
| 217 | 0.0008 | 2.49 | 0.9021 | 0.0018 | 0.0019 | 4.01 | 0.05 | — | — | — | — | — |

| | Composition (mass %) | | | | | | | |
|---|---|---|---|---|---|---|---|---|
| No. | Ba | Ce | La | Nd | Pr | Zn | Cd | Left side of formula |
| 201 | — | — | — | — | — | — | — | 0.57 |
| 202 | — | — | — | — | — | — | — | 0.58 |
| 203 | — | — | — | — | — | — | — | 0.60 |
| 204 | — | — | — | — | — | — | — | 0.54 |
| 205 | — | — | — | — | — | — | — | 0.52 |
| 206 | — | — | — | — | — | — | — | 0.57 |
| 207 | — | — | — | — | — | — | — | 0.58 |
| 208 | 0.0047 | — | — | — | — | — | — | 0.53 |
| 209 | — | 0.0052 | — | — | — | — | — | 0.64 |
| 210 | — | — | 0.0053 | — | — | — | — | 0.55 |
| 211 | — | — | — | 0.0051 | — | — | — | 0.53 |
| 212 | — | — | — | — | 0.0054 | — | — | 0.56 |
| 213 | — | — | — | — | — | 0.0048 | — | 0.58 |
| 214 | — | — | — | — | — | — | 0.0051 | 0.56 |
| 215 | — | — | — | — | — | — | — | 0.59 |
| 216 | — | — | — | — | — | — | — | 0.62 |
| 217 | — | — | — | — | — | — | — | 0.62 |

TABLE 4

| | Rolling reduction (%) | | | | | B50 after annealing at 800° C. for two hours (T) | | | | | | | | |
|---|---|---|---|---|---|---|---|---|---|---|---|---|---|---|
| | | | Characteristics of steel sheet | | | Whole | | | | | | | | |
| No. | Cold rolling | Skin pass rolling | Sac | Sbc | Sag | circumference average B50 (T) | W10/400 (W/kg) | B50D1 (T) | B50D2 (T) | B50L (T) | B50C (T) | Formula (2) | Formula (3) | Note |
| 201 | 85 | 9 | 0.239 | 0.092 | 0.011 | 1.679 | 15.32 | 1.812 | 1.798 | 1.561 | 1.544 | ○ | ○ | Invention Example |
| 202 | 85 | 9 | 0.237 | 0.089 | 0.010 | 1.701 | 15.34 | 1.821 | 1.822 | 1.549 | 1.613 | ○ | ○ | Invention Example |
| 203 | 85 | 9 | 0.239 | 0.086 | 0.011 | 1.702 | 15.28 | 1.818 | 1.826 | 1.567 | 1.596 | ○ | ○ | Invention Example |
| 204 | 85 | 9 | 0.240 | 0.087 | 0.007 | 1.703 | 15.31 | 1.824 | 1.835 | 1.568 | 1.587 | ○ | ○ | Invention Example |
| 205 | 85 | 9 | 0.241 | 0.088 | 0.008 | 1.682 | 14.93 | 1.809 | 1.808 | 1.539 | 1.571 | ○ | ○ | Invention Example |
| 206 | 85 | 9 | 0.238 | 0.090 | 0.013 | 1.678 | 14.90 | 1.813 | 1.802 | 1.541 | 1.556 | ○ | ○ | Invention Example |
| 207 | 85 | 9 | 0.243 | 0.087 | 0.011 | 1.682 | 14.93 | 1.808 | 1.824 | 1.536 | 1.561 | ○ | ○ | Invention Example |
| 208 | 85 | 9 | 0.237 | 0.092 | 0.010 | 1.681 | 14.87 | 1.808 | 1.799 | 1.568 | 1.549 | ○ | ○ | Invention Example |
| 209 | 85 | 9 | 0.238 | 0.090 | 0.008 | 1.680 | 14.90 | 1.812 | 1.827 | 1.560 | 1.521 | ○ | ○ | Invention Example |
| 210 | 85 | 9 | 0.244 | 0.088 | 0.011 | 1.678 | 14.87 | 1.809 | 1.827 | 1.549 | 1.525 | ○ | ○ | Invention Example |
| 211 | 85 | 9 | 0.239 | 0.087 | 0.012 | 1.681 | 14.89 | 1.809 | 1.812 | 1.542 | 1.560 | ○ | ○ | Invention Example |
| 212 | 85 | 9 | 0.240 | 0.087 | 0.014 | 1.677 | 14.93 | 1.810 | 1.824 | 1.561 | 1.514 | ○ | ○ | Invention Example |
| 213 | 85 | 9 | 0.243 | 0.089 | 0.013 | 1.677 | 14.86 | 1.809 | 1.817 | 1.545 | 1.539 | ○ | ○ | Invention Example |
| 214 | 85 | 9 | 0.242 | 0.093 | 0.011 | 1.677 | 14.93 | 1.814 | 1.808 | 1.548 | 1.537 | ○ | ○ | Invention Example |
| 215 | 85 | 3 | 0.223 | 0.061 | 0.031 | 1.690 | 15.31 | 1.768 | 1.753 | 1.636 | 1.601 | ○ | X | Invention Example |

TABLE 4-continued

| No. | Rolling reduction (%) Cold rolling | Skin pass rolling | Characteristics of steel sheet Sac | Sbc | Sag | B50 after annealing at 800° C. for two hours (T) Whole circumference average B50 (T) | W10/400 (W/kg) | B50D1 (T) | B50D2 (T) | B50L (T) | B50C (T) | Formula (2) | Formula (3) | Note |
|---|---|---|---|---|---|---|---|---|---|---|---|---|---|---|
| 216 | 85 | 9 | 0.237 | 0.093 | 0.011 | 1.648 | 14.32 | 1.765 | 1.788 | 1.530 | 1.511 | ○ | ○ | Invention Example |
| 217 | 85 | 9 | 0.240 | 0.092 | 0.009 | 1.640 | 13.80 | 1.770 | 1.745 | 1.517 | 1.528 | ○ | ○ | Invention Example |

No. 201 to No. 217 were all invention examples and all had favorable magnetic characteristics. In particular, the magnetic flux densities B50 were higher in No. 202 to No. 204 than in No. 201, No. 205 to No. 217, and the iron losses W10/400 were lower in No. 205 to No. 214, No. 217 and No. 217 than in No. 201 to No. 204 and No. 215. It is considered that these results were obtained by adjusting the compositions of the non-oriented electrical steel sheets. In addition, in No. 215, the magnetic characteristics were favorable, but the rolling reduction in the skin pass rolling was changed, and thus Formula (3) was not satisfied.

Third Example

Molten steel was cast, thereby producing ingots having compositions shown in Table 5 below. After that, the produced ingots were hot-rolled by being heated up to 1150° C. and rolled such that the sheet thicknesses reached 2.5 mm. In addition, after the end of finish rolling, the hot-rolled steel sheets were cooled with water and wound. The finishing temperature in a stage of the final pass of the finish rolling at this time was 830° C. and all temperatures were higher than the Ar1 temperature. In addition, the hot-rolled steel sheets were wound at winding temperatures shown in Table 6, respectively.

Next, the hot-rolled steel sheets were pickled to remove scales and cold-rolled in a rolling reduction of 85% until the sheet thicknesses reached 0.385 mm. In addition, intermediate annealing was carried out in a non-oxidizing atmosphere for 30 seconds, and the temperatures in the intermediate annealing were controlled such that the recrystallization rates became 85%. Next, a second round of the cold rolling (skin pass rolling) was carried out in a rolling reduction of 9% until the sheet thicknesses reached 0.35 mm.

Next, stress relief annealing was carried out at 800° C. for two hours after the second round of the cold rolling (skin pass rolling) in order to investigate the magnetic characteristics, and, similar to the second example, the magnetic flux densities B50 and the iron losses W10/400 were measured. The magnetic flux density B50 in each direction was measured in the same order as in the first example. On the other hand, the iron loss W10/400 was measured as an energy loss (W/kg) on a whole circumference average that was caused in a sample when an alternating-current magnetic field of 400 Hz was applied such that the maximum magnetic flux density reached 1.0 T. These conditions and results are shown in Table 5 and Table 6.

In addition, ½ layers of the steel sheets after the skin pass rolling were exposed by polishing and measured by SEM-EBSD, and the area ratios of crystal grains in each orientation and the KAM values were calculated using OIM Analysis. In addition, Sac, Sbc and Sag were each calculated from the obtained KAM values. The calculation methods therefor are as described above in the embodiment. The observed visual fields were 2400 μm, and each numerical value is the average value of each sample.

TABLE 5

| Composition | Composition (mass %) C | Si | sol-Al | S | N | Mn | Left side of formula |
|---|---|---|---|---|---|---|---|
| A | 0.0009 | 2.51 | 0.0107 | 0.0022 | 0.0020 | 3.10 | 0.57 |
| B | 0.0008 | 2.49 | 0.2995 | 0.0020 | 0.0021 | 3.41 | 0.61 |
| C | 0.0012 | 2.49 | 0.4487 | 0.0021 | 0.0019 | 3.54 | 0.60 |
| D | 0.0009 | 2.50 | 0.6014 | 0.0018 | 0.0018 | 3.70 | 0.60 |
| E | 0.0009 | 2.50 | 0.7501 | 0.0019 | 0.0021 | 3.87 | 0.62 |

TABLE 6

| No. | Composition | Characteristics of steel sheet Sac | Sbc | Sag | Winding temperature (° C.) | B50 after annealing at 800° C. for two hours (T) Whole circumference average B50 (T) | W10/400 (W/kg) | B50D1 (T) | B50D2 (T) | B50L (T) | B50C (T) | Formula (2) | Formula (3) | Note |
|---|---|---|---|---|---|---|---|---|---|---|---|---|---|---|
| 301 | A | 0.242 | 0.091 | 0.006 | 500 | 1.673 | 15.33 | 1.796 | 1.794 | 1.560 | 1.546 | ○ | ○ | Invention Example |
| 302 | A | 0.241 | 0.090 | 0.009 | 600 | 1.677 | 15.27 | 1.783 | 1.785 | 1.561 | 1.579 | ○ | ○ | Invention Example |
| 303 | A | 0.057 | 0.081 | 0.044 | 700 | 1.649 | 15.84 | 1.719 | 1.718 | 1.575 | 1.580 | ○ | X | Comparative Example |
| 304 | A | 0.241 | 0.089 | 0.007 | 400 | 1.671 | 15.28 | 1.789 | 1.789 | 1.562 | 1.547 | ○ | ○ | Invention Example |

TABLE 6-continued

| No. | Composition | Characteristics of steel sheet Sac | Sbc | Sag | Winding temperature (° C.) | B50 after annealing at 800° C. for two hours (T): Whole circumference average B50 (T) | W10/400 (W/kg) | B50D1 (T) | B50D2 (T) | B50L (T) | B50C (T) | Formula (2) | Formula (3) | Note |
|---|---|---|---|---|---|---|---|---|---|---|---|---|---|---|
| 305 | A | 0.242 | 0.089 | 0.008 | 300 | 1.669 | 15.40 | 1.785 | 1.786 | 1.558 | 1.542 | ○ | ○ | Invention Example |
| 306 | A | 0.058 | 0.081 | 0.041 | 200 | 1.650 | 15.82 | 1.748 | 1.750 | 1.540 | 1.565 | ○ | ○ | Comparative Example |
| 307 | B | 0.242 | 0.091 | 0.006 | 500 | 1.671 | 15.11 | 1.788 | 1.790 | 1.555 | 1.553 | ○ | ○ | Invention Example |
| 308 | B | 0.241 | 0.090 | 0.009 | 600 | 1.671 | 14.99 | 1.782 | 1.782 | 1.555 | 1.567 | ○ | ○ | Invention Example |
| 309 | B | 0.057 | 0.081 | 0.044 | 700 | 1.645 | 15.55 | 1.714 | 1.714 | 1.574 | 1.581 | ○ | X | Comparative Example |
| 310 | B | 0.241 | 0.089 | 0.007 | 400 | 1.665 | 15.10 | 1.785 | 1.784 | 1.554 | 1.537 | ○ | ○ | Invention Example |
| 311 | B | 0.242 | 0.089 | 0.008 | 300 | 1.663 | 15.09 | 1.781 | 1.782 | 1.555 | 1.536 | ○ | ○ | Invention Example |
| 312 | B | 0.058 | 0.081 | 0.041 | 200 | 1.646 | 15.61 | 1.747 | 1.746 | 1.534 | 1.563 | ○ | ○ | Comparative Example |
| 313 | C | 0.242 | 0.091 | 0.006 | 500 | 1.667 | 14.80 | 1.783 | 1.787 | 1.552 | 1.546 | ○ | ○ | Invention Example |
| 314 | C | 0.241 | 0.090 | 0.009 | 600 | 1.664 | 14.76 | 1.774 | 1.777 | 1.552 | 1.554 | ○ | ○ | Invention Example |
| 315 | C | 0.057 | 0.081 | 0.044 | 700 | 1.642 | 15.32 | 1.709 | 1.711 | 1.582 | 1.567 | ○ | X | Comparative Example |
| 316 | C | 0.241 | 0.089 | 0.007 | 400 | 1.659 | 14.78 | 1.779 | 1.780 | 1.551 | 1.524 | ○ | ○ | Invention Example |
| 317 | C | 0.242 | 0.089 | 0.008 | 300 | 1.658 | 14.87 | 1.776 | 1.777 | 1.551 | 1.526 | ○ | ○ | Invention Example |
| 318 | C | 0.058 | 0.081 | 0.041 | 200 | 1.640 | 15.32 | 1.741 | 1.738 | 1.530 | 1.553 | ○ | ○ | Comparative Example |
| 319 | D | 0.244 | 0.092 | 0.006 | 500 | 1.659 | 14.29 | 1.777 | 1.780 | 1.546 | 1.534 | ○ | ○ | Invention Example |
| 320 | D | 0.057 | 0.081 | 0.040 | 700 | 1.629 | 14.79 | 1.705 | 1.705 | 1.552 | 1.554 | ○ | X | Comparative Example |
| 321 | D | 0.056 | 0.083 | 0.043 | 200 | 1.630 | 14.83 | 1.734 | 1.736 | 1.519 | 1.530 | ○ | ○ | Comparative Example |
| 322 | E | 0.242 | 0.090 | 0.007 | 500 | 1.655 | 13.84 | 1.774 | 1.775 | 1.540 | 1.532 | ○ | ○ | Invention Example |
| 323 | E | 0.056 | 0.079 | 0.041 | 700 | 1.627 | 14.65 | 1.702 | 1.702 | 1.555 | 1.549 | ○ | X | Comparative Example |
| 324 | E | 0.057 | 0.082 | 0.042 | 200 | 1.617 | 14.62 | 1.728 | 1.727 | 1.513 | 1.501 | ○ | ○ | Comparative Example |

Underlined values in Table 6 indicate conditions deviating from the scope of the present invention. In all of No. 301, No. 302, No. 304, No. 305, No. 307, No. 308, No. 310, No. 311, No. 313, No. 314, No. 316, No. 317, No. 319 and No. 322, which were invention examples, the magnetic flux densities B50 were favorable values both in the 45° direction and on the whole circumference average. On the other hand, in No. 303, No. 306, No. 309, No. 312, No. 315, No. 318, No. 320, No. 321, No. 323 and No. 324, which were comparative examples, since the winding temperatures deviated from the optimal range, the relationship of Sac>Sbc>Sag was not satisfied, and the magnetic flux densities B50 were all low.

As is understood from the above-described examples, the non-oriented electrical steel sheet according to the present invention has excellent magnetic characteristics on a whole circumference average (all-direction average) since the chemical composition, the hot rolling conditions, the cold rolling conditions, the annealing conditions and the recrystallization rate are appropriately controlled.

INDUSTRIAL APPLICABILITY

According to the present invention, it is possible to provide a non-oriented electrical steel sheet in which excellent magnetic characteristics can be obtained on a whole circumference average (all-direction average), and thus the present invention is extremely industrially available.

What is claimed is:

1. A non-oriented electrical steel sheet having a chemical composition in which, by mass %:

C: 0.010% or less,

Si: 1.50% to 4.00%, sol. Al: 0.0001% to 1.0%,

S: 0.010% or less,

N: 0.010% or less, one or a plurality of elements selected from the group consisting of Mn, Ni, Co, Pt, Pb, Cu and Au: 2.50% to 5.00% in total, Sn: 0.000% to 0.400%, Sb: 0.000% to 0.400%, P: 0.000% to 0.400%, and one or a plurality of elements selected from the group consisting of Mg, Ca, Sr, Ba, Ce, La, Nd, Pr, Zn and Cd: 0.0000% to 0.0100% in total are contained, when a Mn content (mass %) is indicated by [Mn], a Ni content (mass %) is indicated by [Ni], a Co content (mass %) is indicated by [Co], a Pt content (mass %) is indicated by [Pt], a Pb content (mass %) is indicated by

[Pb], a Cu content (mass %) is indicated by [Cu], a Au content (mass %) is indicated by [Au], a Si content (mass %) is indicated by [Si], and a sol. Al content (mass %) is indicated by [sol. Al], Formula (1) below is satisfied, and a remainder includes Fe and impurities, wherein a sheet thickness is 0.50 mm or less, and, in an arbitrary cross section, when an area ratio of {100} crystal grains is indicated by Sac, an area ratio of {110} crystal grains is indicated by Sag, and an area ratio of the {100} crystal grains in a region of up to 20% from a side where a kernel average misorientation (KAM) value is high is indicated by Sbc, Sac>Sbc>Sag and 0.05>Sag are satisfied, $$([Mn]+[Ni]+[Co]+[Pt]+[Pb]+[Cu]+[Au])-([Si]+[sol.\ Al])>0\% \quad (1).$$

2. The non-oriented electrical steel sheet according to claim 1, wherein, when a value of a magnetic flux density B50 in a rolling direction is indicated by B50L, a value of a magnetic flux density B50 in a direction at an angle of 45° from the rolling direction is indicated by B50D1, a value of a magnetic flux density B50 in a direction at an angle of 90° from the rolling direction is indicated by B50C, and a value of a magnetic flux density B50 in a direction at an angle of 135° from the rolling direction is indicated by B50D2, after the non-oriented electrical steel sheet is annealed at 800° C. for two hours, Formula (2) below is satisfied, $$(B50D1+B50D2)/2>(B50L+B50C)/2 \quad (2).$$

3. The non-oriented electrical steel sheet according to claim 2, wherein Formula (3) below is satisfied, $$(B50D1+B50D2)/2>1.1\times(B50L+B50C)/2 \quad (3).$$

4. The non-oriented electrical steel sheet according to claim 3, further comprising, by mass %, one or a plurality of elements selected from the group consisting of: Sn: 0.020% to 0.400%, Sb: 0.020% to 0.400%, and P: 0.020% to 0.400%.

5. The non-oriented electrical steel sheet according to claim 4, further comprising, by mass %, one or a plurality of elements selected from the group consisting of: Mg, Ca, Sr, Ba, Ce, La, Nd, Pr, Zn and Cd: 0.0005% to 0.0100% in total.

6. The non-oriented electrical steel sheet according to claim 3, further comprising, by mass %, one or a plurality of elements selected from the group consisting of: Mg, Ca, Sr, Ba, Ce, La, Nd, Pr, Zn and Cd: 0.0005% to 0.0100% in total.

7. The non-oriented electrical steel sheet according to claim 2, further comprising, by mass %, one or a plurality of elements selected from the group consisting of: Sn: 0.020% to 0.400%, Sb: 0.020% to 0.400%, and P: 0.020% to 0.400%.

8. The non-oriented electrical steel sheet according to claim 7, further comprising, by mass %, one or a plurality of elements selected from the group consisting of: Mg, Ca, Sr, Ba, Ce, La, Nd, Pr, Zn and Cd: 0.0005% to 0.0100% in total.

9. The non-oriented electrical steel sheet according to claim 2, further comprising, by mass %, one or a plurality of elements selected from the group consisting of: Mg, Ca, Sr, Ba, Ce, La, Nd, Pr, Zn and Cd: 0.0005% to 0.0100% in total.

10. The non-oriented electrical steel sheet according to claim 1, further comprising, by mass %, one or a plurality of elements selected from the group consisting of: Sn: 0.020% to 0.400%, Sb: 0.020% to 0.400%, and P: 0.020% to 0.400%.

11. The non-oriented electrical steel sheet according to claim 10, further comprising, by mass %, one or a plurality of elements selected from the group consisting of: Mg, Ca, Sr, Ba, Ce, La, Nd, Pr, Zn and Cd: 0.0005% to 0.0100% in total.

12. The non-oriented electrical steel sheet according to claim 1, further comprising, by mass %, one or a plurality of elements selected from the group consisting of: Mg, Ca, Sr, Ba, Ce, La, Nd, Pr, Zn and Cd: 0.0005% to 0.0100% in total.

* * * * *